US010494231B1

(12) United States Patent
Babinchak et al.

(10) Patent No.: US 10,494,231 B1
(45) Date of Patent: Dec. 3, 2019

(54) WOVEN STRAP WITH OUT OF SERVICE MARKER

(71) Applicant: Lift-All Company, Inc., Landisville, PA (US)

(72) Inventors: Gregory S. Babinchak, Elizabethtown, PA (US); Steven Pacilio, Landisville, PA (US)

(73) Assignee: Lift-All Company, Inc., Landisville, PA (US)

( * ) Notice: Subject to any disclaimer, the term of this patent is extended or adjusted under 35 U.S.C. 154(b) by 0 days.

(21) Appl. No.: 16/373,042

(22) Filed: Apr. 2, 2019

(51) Int. Cl.
*B66C 1/12* (2006.01)
*B66C 1/18* (2006.01)
*D03D 1/00* (2006.01)

(52) U.S. Cl.
CPC *B66C 1/18* (2013.01); *D03D 1/00* (2013.01)

(58) Field of Classification Search
CPC ..... B66C 1/18; D03D 1/00
USPC ..... 294/74
See application file for complete search history.

(56) References Cited

U.S. PATENT DOCUMENTS 4,025,100 A * 5/1977 Bridgehouse ..... B66C 1/18 294/74
4,702,508 A 10/1987 Weiner et al.
5,651,572 A * 7/1997 St. Germain ..... B66C 1/12 294/74
5,727,833 A * 3/1998 Coe ..... B66C 1/12 294/74
5,785,146 A * 7/1998 Palmer ..... A62B 35/0068 182/3
6,149,215 A * 11/2000 Balogh ..... B66C 1/18 294/74
7,658,423 B1 * 2/2010 Carmichael ..... B66C 1/12 294/74
9,597,996 B2 3/2017 Babinchak
2015/0199893 A1 * 7/2015 St. Germain ..... B66C 15/00 340/539.1
2015/0259852 A1 * 9/2015 Matsumoto ..... A01K 27/003 428/369

* cited by examiner

*Primary Examiner* — Paul T Chin
(74) *Attorney, Agent, or Firm* — Saxton & Stump LLC

(57) ABSTRACT

A woven webbing, for use in a tiedown or sling for lifting, restraint or other material handling functions, has a webbing width which extends from a first edge surface of the woven webbing to a second edge surface of the webbing. Visible out of service markers are woven in the woven webbing at designated distances from the edge surfaces. The out of service markers are visually distinct from woven webbing material of the woven webbing. The visible out of service markers serve as a tool for indicating when the amount of damage concentrated along the edge of the webbing has penetrated to a level such that the woven webbing needs to be taken out of service.

20 Claims, 3 Drawing Sheets

WOVEN STRAP WITH OUT OF SERVICE MARKER

FIELD OF THE INVENTION

The present invention is directed a tiedown or sling with an out of service marker. In particular, the invention is directed to a woven webbing for a tiedown or sling having visible marker placed proximate to edges of the webbing to assist users in identifying when the edge of the webbing is excessively worn.

BACKGROUND OF THE INVENTION

Woven webbings have long been used as tiedowns, straps and/or slings keep them in service until they are worn or damaged to an acceptable limit. The damage to the webbing of the tiedowns, straps and/or slings is often concentrated along the edge of the webbing, causing it to become weak, increasing the risk of failure. Once the acceptable limit is reached, the tiedowns, straps and/or slings should be taken out of service to prevent damage or injury due to the failure of the tiedowns, straps and/or slings.

It would, therefore, be beneficial to provide woven tiedowns, straps and/or slings having an indicator or marker which is provided proximate the edges of the slings to provide a visual indication of when the acceptable limit of the tiedowns, straps and/or slings is reached. In particular, in would be beneficial to provide one or more marker yarns, placed along each edge of the webbing of the woven tiedowns, straps and/or slings at a set distance from the edge to service as an out of service tool to assist users in identifying when the edge of the webbing is excessively worn, cut or otherwise damaged, to an extent whereby the webbing product needs to be removed from service.

SUMMARY OF THE INVENTION

An object of the invention is to provide a tiedown or sling for lifting, restraint or other material handling functions, which is constructed of webbing having an indicator or marker which is provided proximate the edges of the webbing to provide a visual indication of when the acceptable limit of damage to the tiedown or sling is reached.

An object of the invention is to provide one or more marker yarns, placed along each edge of the webbing of the tiedown or sling at a set distance from the edge to service as an out of service tool to assist users in identifying when the edge of the webbing is excessively worn, cut or otherwise damaged to an extent whereby the webbing product needs to be removed from service An embodiment is directed to a tiedown or sling for lifting, restraint or other material handling functions. The woven webbing has a top surface and an oppositely facing bottom surface. Edge surfaces extend between the top surface and the bottom surface. The woven webbing has a webbing width which extends from a first edge surface of the edge surfaces to a second edge surface of the edge surfaces. Out of service markers are woven in the webbing at designated distances from the edge surfaces, wherein the out of service markers are visible on the top surface or are visible on the bottom surface, or both. The out of service markers are visually distinct from woven webbing material of the woven webbing. The designated distance of a first out of service marker of the out of service markers from the first edge surface is equal to or less than 20% of the webbing width and the designated distance of a second out of service marker of the out of service markers from the second edge surface is equal to or less than 20% of the webbing width. The out of service markers serve as a tool for indicating when the amount of damage concentrated along the edge of the webbing has penetrated to a level such that the woven webbing needs to be taken out of service.

An embodiment is directed to a tiedown or sling for lifting, restraint or other material handling functions. The woven webbing has a top surface, an oppositely facing bottom surface, and edge surfaces which extend between the top surface and the bottom surface. The woven webbing has a webbing width which extends from a first edge surface of the edge surfaces to a second edge surface of the edge surfaces. Visible out of service markers are provided in the woven webbing at designated distances from the edge surfaces. The out of service markers are visible on the top surface and are visible on the bottom surface. The out of service markers are visually distinct from woven webbing material of the woven webbing and extend the entire length of the woven webbing. A first out of service marker of the out of service markers extends in a direction which is parallel to the first edge surface and a second out of service marker of the out of service markers extends in a direction which is parallel to the second edge surface. The visible out of service markers serve as a tool for indicating when the amount of damage concentrated along the edge of the webbing has penetrated to a level such that the woven webbing needs to be taken out of service.

An embodiment is directed to a woven webbing for a tiedown or sling. The woven tiedown or sling includes a woven webbing which has a top surface, an oppositely facing bottom surface, and edge surfaces which extend between the top surface and the bottom surface. The woven webbing has a webbing width which extends from a first edge surface of the edge surfaces to a second edge surface of the edge surfaces. Visible out of service markers are provided in the woven webbing and are spaced from the edge surfaces. The out of service markers are visible on the top surface and are visible on the bottom surface. Damage indicators are provided in the woven webbing and are positioned between the out of service markers and the edge surfaces. The damage indicators are visible on the top surface and are visible on the bottom surface. The damage indicators indicates when the woven webbing is nearing a time to be taken out of service and the visible out of service markers serve as a tool for indicating when the amount of damage concentrated along the edge of the webbing has penetrated to a level such that the woven webbing needs to be taken out of service.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
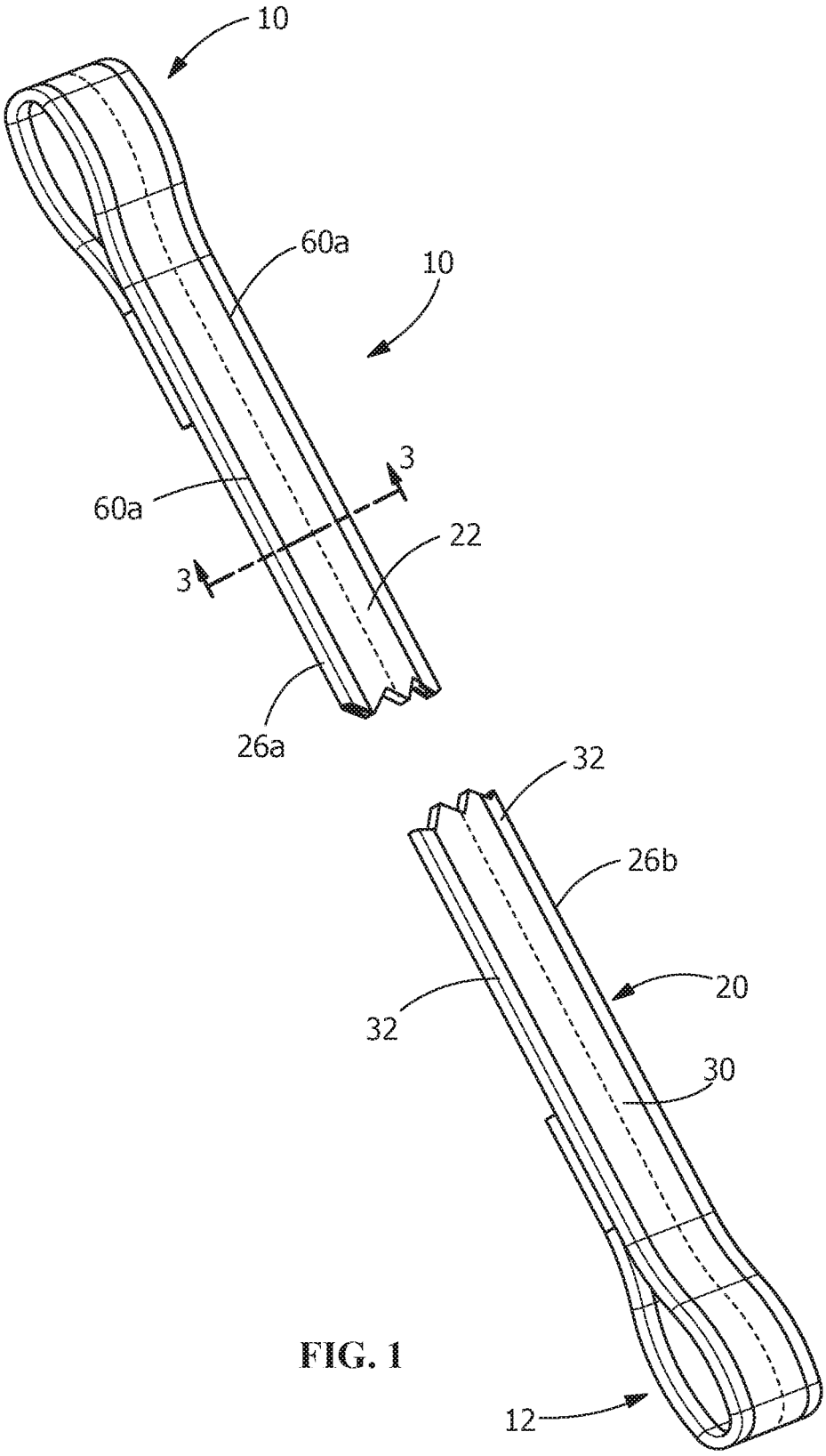
FIG. 1 is a perspective view of an illustrative embodiment of a sling of the present invention, the sling having out of service markers extending lengthwise proximate the side edges of the sling.
Figure 2:
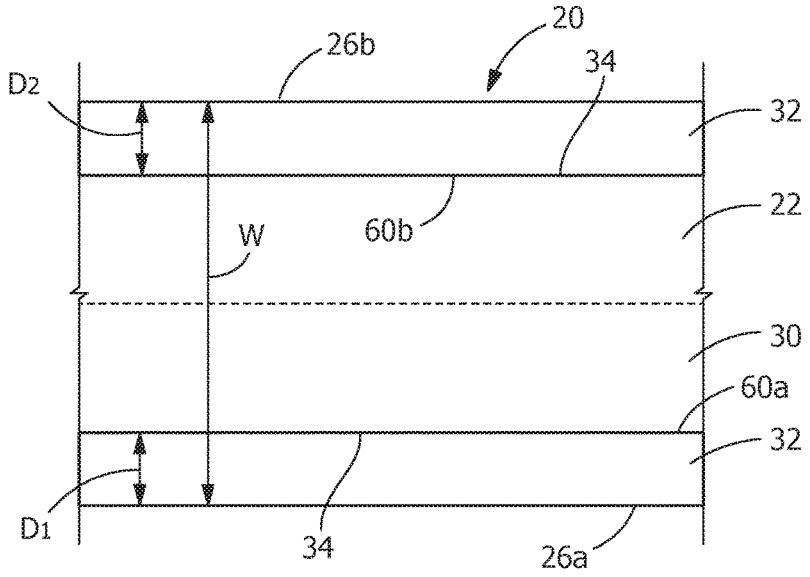
FIG. 2 is a top view of a portion of the sling of FIG. 1.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Moreover, the features and benefits of the invention are illustrated by reference to the preferred embodiments. Accordingly, the invention expressly should not be limited to such embodiments illustrating some possible non-limiting combination of features that may exist alone or in other combinations of features, the scope of the invention being defined by the claims appended hereto.

As shown in FIG. 1, an illustrative tiedown or sling 10, for lifting, restraint or other material handling functions, includes, soft eyes 12 and either end. While the eyes 12 are shown at either end, other embodiments of the tiedown or sling 10 may be used without departing from the scope of the invention. The tiedown or sling 10 may be used to lift or lash an object or may be used as a component of a device which used for lifting or lashing. The tiedown or sling 10 is made of a woven webbing 20 which may be made of one or more layers or plies of woven webbing material.

Figure 3:
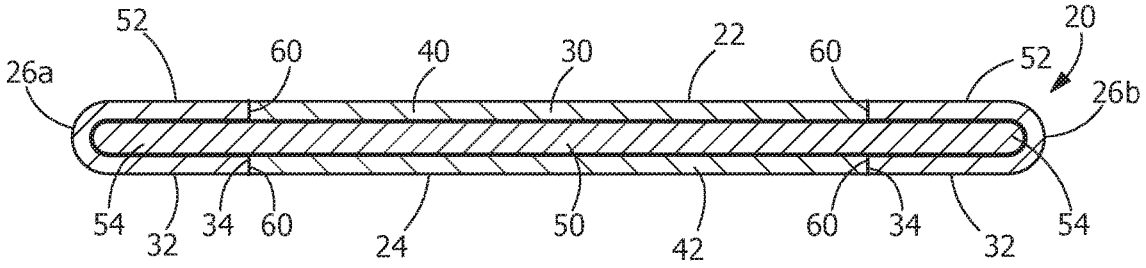
FIG. 3 is a cross-sectional view of the sling taken along line 3-3 of FIG. 2.

As best shown in FIG. 3, the woven webbing 20 has a first or top surface 22, an oppositely facing second or bottom surface 24 and edge surfaces 26 which extend between the top surface 22 and the bottom surface 24. The edge surfaces 26 include a first edge surface 26*a* and an oppositely facing second edge surface 26*b*. The first edge surface 26*a* and the second edge surface 26*b* extend essentially parallel to each other. A width W of the woven webbing 20 extends from the first edge surface 26*a* to the second edge surface 26*b*.

In the illustrative embodiment shown the woven webbing 20 has a central portion 30 and cut resistant edge portions 32. The edge portions 32 extend continuously between the opposing edge surfaces 26 of the woven webbing 20 and opposing edges 34 of the central portion 30. The edge portions 32 afford protection of the central portion 30 against abrading or cutting at any point along the opposing edges 34 of the central portion 30. While the illustrative embodiment shown in FIGS. 1 through 4 illustrate the woven webbing 20 having the central portion 30 and cut resistant edge portions 32, the woven webbing 20 may have different configurations without departing from the scope of the invention. As an example, the woven webbing 20 may not have distinct cut resistant edge portions 32 extending from the edge surfaces 26 of the woven webbing 20.

Referring again to FIG. 3, the central portion 30 has an upper ply 40 and a lower ply 42. The upper and lower plies 40, 42 are formed of warp yarns continuously woven with weft yarns, as is known in the industry. The upper and lower plies 40, 42 are bound together along the central portion 30 by binder yarns, as is known in the industry. Stuffer yarns 50 are sandwiched between the upper and lower plies 40, 42 and are bound in place in the central portion 30 by the binder yarns 38.

The upper and lower plies 40, 42 are unbound along their periphery, thereby forming a pair of tubes 52 defining the cut resistant edge portions 32. In the illustrative embodiment, stuffer yarns 54 also are contained in the tubes 52.

Figure 4:
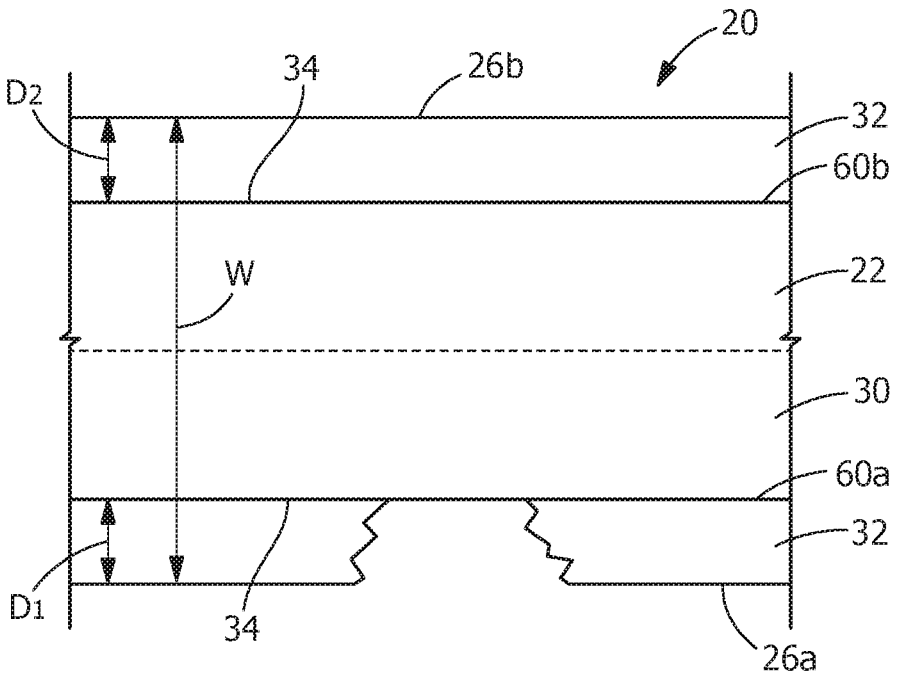
FIG. 4 is a top view f the sling, illustrating a worn portion of the sling.

Visible out of service markers 60 are woven in the woven webbing 20 and are spaced at designated distances D from the edge surfaces 26 of the woven webbing 20. The out of service markers 60 are positioned on a top surface 22 of the woven webbing 20, are positioned on a bottom surface 24 of the woven webbing 20, are positioned on both the top surface 22 and the bottom surface 24, or extend from the top surface 22 of the woven webbing 20 to the bottom surface 24 of the woven webbing. The out of service markers 60 are visible on the top surface 22 or are visible on the bottom surface 24, or both. The out of service markers 60 are visually distinct from the material of the woven webbing 20. The visible out of service markers 60 serve as a tool for indicating when the amount of damage concentrated along the edge surfaces 26 of the woven webbing 20 has penetrate to a level such that the woven webbing 20 needs to be taken out of service, as is illustrated in FIG. 4.

In one example, the designated distance D1 of a first out of service marker 60*a* of the out of service markers 60 from the first edge surface 26*a* is equal to or less than 20% of the webbing width W and the designated distance D2 of a second out of service marker 60*b* of the out of service markers 60 from the second edge surface 26*b* is equal to or less than 20% of the webbing width.

In another example, the designated distance D1 of a first out of service marker 60*a* of the out of service markers 60 from the first edge surface 26*a* is equal to or less than 15% of the webbing width W and the designated distance D2 of a second out of service marker 60*b* of the out of service markers 60 from the second edge surface 26*b* is equal to or less than 15% of the webbing width.

In another example, the designated distance D1 of a first out of service marker 60*a* of the out of service markers 60 from the first edge surface 26*a* is equal to or less than 10% of the webbing width W and the designated distance D2 of a second out of service marker 60*b* of the out of service markers 60 from the second edge surface 26*b* is equal to or less than 10% of the webbing width.

In another example, the designated distance D1 of a first out of service marker 60*a* of the out of service markers 60 from the first edge surface 26*a* is greater than 5% and less than 20% of the webbing width W and the designated distance D2 of a second out of service marker 60*b* of the out of service markers 60 from the second edge surface 26*b* is greater than 5% and less than 20% of the webbing width.

In another example, the designated distance D1 of a first out of service marker 60*a* of the out of service markers 60 from the first edge surface 26*a* is greater than 5% and less than 15% of the webbing width W and the designated distance D2 of a second out of service marker 60*b* of the out of service markers 60 from the second edge surface 26*b* is greater than 5% and less than 15% of the webbing width.

Depending, for example upon the material and weave pattern of the woven webbing illustrative examples of the location of the out of service marker include, but are not limited to:

| Width W of Webbing | Out of Service Marker Location from Edge | Out of Service Marker Percentage of Width W |
|---|---|---|
| 1" | .094 +/− .02" | 9.4% |
| 2" | .172 +/− .02" | 8.6% |
| 3" | .250" +/− .03" | 8.3% |
| 4" | .312" +/− .03" | 7.3% |
| 6" | .438" +/− .05" | 7.1% |
| 8" | .500" +/− .05" | 6.2% |
| 10" | .625" +/− .06" | 6.2% |
| 12" | .687" +/− .06" | 5.7% |

The out of service markers 60 extend the entire length of the woven webbing 20. The first out of service marker 60*a* extends in a direction which is parallel to the first edge surface 26*a* and the second out of service marker 60*b* extends in a direction which is parallel to the second edge surface 26*b*.

The out of service markers 60 may be yarn which is woven into the woven webbing 20. The out of service markers 60 may be a different color yarn than the color of the material of the woven webbing 20. The out of service markers 60 may also be a coated yarn to increase the stiffness of the out of service markers 60.

Figure 5:
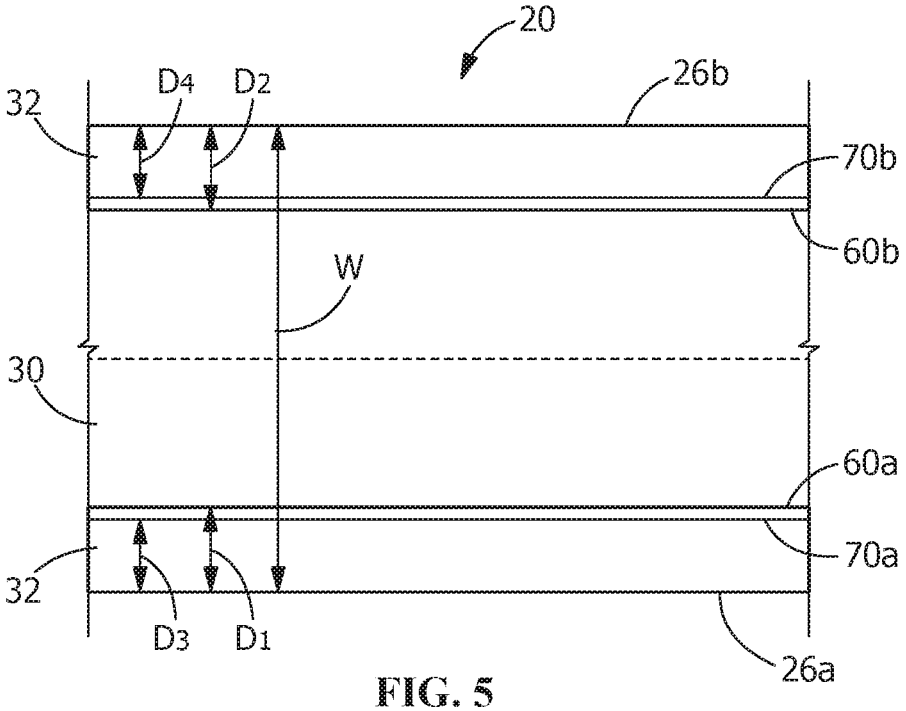
FIG. 5 is a top view of an alternate illustrative embodiment of the webbing of a sling of the present invention, the sling having damage indicators and out of service markers extending lengthwise proximate edges of the webbing.

Referring to FIG. 5, an alternate illustrative embodiment of the tiedown or sling 10 is shown. In this embodiment, damage indicators 70 are woven in the woven webbing 20 and are positioned between the out of service markers 60 and the edge surfaces 26 of the woven webbing 20. The damage indicators 70 are positioned on a top surface 22 of the woven webbing 20, are positioned on a bottom surface 24 of the woven webbing 20, are positioned on both the top surface 22 and the bottom surface 24, or extend from the top surface 22 of the woven webbing 20 to the bottom surface 24 of the woven webbing. The damage indicators 70 are visible on the top surface 22 or are visible on the bottom surface 24, or both. The damage indicators 70 are visually distinct from the out of service markers 60 and the material of the woven webbing 20.

In one illustrative example, a distance D3 of a first damage indicator 70*a* of the damage indicators 70 from the first edge surface 26*a* is equal to or less than 90% of designated distance D1 of the first out of service marker 60*a* from the first edge surface 26*a* and a distance D4 of a second damage indicator 70*b* of the damage indicators 70 from the second edge surface 26*b* is equal to or less than 90% of designated distance D2 of the second out of service marker 60*b* from the second edge surface 26*b*. The damage indicators 70 indicate when the woven webbing 20 is nearing a time to be taken out of service.

In another example, a distance D3 of a first damage indicator 70*a* of the damage indicators 70 from the first edge surface 26*a* is greater than 80% but less than 100% of designated distance D1 of the first out of service marker 60*a* from the first edge surface 26*a* and a distance D4 of a second damage indicator 70*b* of the damage indicators 70 from the second edge surface 26*b* is greater than 80% but less than 100% of designated distance D2 of the second out of service marker 60*b* from the second edge surface 26*b*. The damage indicators 70 indicate when the woven webbing 20 is nearing a time to be taken out of service.

The visible out of service marker 60 serves a tool for indicating when the amount of damage concentrated along the edge of the webbing has penetrated to a level such that the woven webbing needs to be taken out of service, with the distance D1, D2 being designated based on a targeted amount of retained strength to be maintained before the woven webbing needs to be removed from service whenever damage to the woven webbing is concentrated along the edge of the woven webbing.

The visible out of service marker 60 serves to set a clear limit as to the allowable amount of damage concentrated along the edges of webbing that is commonly used for material handling functions. A clear out of service criteria is established by setting a depth of penetration limit along each edge of the webbing, done by weaving of one or more material markers into the webbing at a designated distance from the edge of the webbing. During use, the webbing will be required to be removed from service once the line of demarcation has been reached.

While the invention has been described with reference to a preferred embodiment, it will be understood by those skilled in the art that various changes may be made and equivalents may be substituted for elements thereof without departing from the spirit and scope of the invention as defined in the accompanying claims. One skilled in the art will appreciate that the invention may be used with many modifications of structure, arrangement, proportions, sizes, materials and components and otherwise used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A woven webbing for use in a tiedown or sling for lifting, restraint or other material handling functions, the woven webbing comprising:

the woven webbing having a top surface and an oppositely facing bottom surface, edge surfaces extend between the top surface and the bottom surface, the woven webbing having a webbing width which extends from a first edge surface of the edge surfaces to a second edge surface of the edge surfaces;

visible out of service markers positioned in the webbing at designated distances from the edge surfaces, wherein the out of service markers are visible on the top surface or are visible on the bottom surface, or both;

the out of service markers are visually distinct from woven webbing material of the woven webbing;

the designated distance of a first out of service marker of the out of service markers from the first edge surface is equal to or less than 20% of the webbing width and the designated distance of a second out of service marker of the out of service markers from the second edge surface is equal to or less than 20% of the webbing width;

wherein the visible out of service markers serve as a tool for indicating when the amount of damage concentrated along the edge of the webbing has penetrated to a level such that the woven webbing needs to be taken out of service.

2. The woven webbing as recited in claim 1, wherein the out of service markers extend the entire length of the woven webbing.

3. The woven webbing as recited in claim 1, wherein the first out of service marker extends in a direction which is parallel to the first edge surface and the second out of service marker extends in a direction which is parallel to the second edge surface.

4. The woven webbing as recited in claim 1, wherein the out of service markers are yarn which are woven into the woven webbing.

5. The woven webbing as recited in claim 4, wherein the out of service markers are a different color yarn than the color of the woven webbing material.

6. The woven webbing as recited in claim 4, wherein the out of service markers are a coated yarn to increase the stiffness of the out of service markers.

7. The woven webbing as recited in claim 1, wherein damage indicators are woven in the woven webbing and are positioned between the out of service markers and the edge surfaces, wherein the damage indicators are visible on the top surface and are visible on the bottom surface, the damage indicators are visually distinct from the out of service markers and the woven webbing material of the woven webbing.

8. The woven webbing as recited in claim 7, wherein a distance of a first damage indicator of the damage indicators from the first edge surface is equal to or less than 90% of designated distance of the first out of service marker from the first edge surface and a distance of a second damage indicator of the damage indicators from the second edge surface is equal to or less than 90% of designated distance of the second out of service marker from the second edge surface, wherein the damage indicators indicate when the woven webbing is nearing a time to be taken out of service.

9. The woven webbing as recited in claim 1, wherein the designated distance is equal to or less than 15% of the webbing width.

10. The woven webbing as recited in claim 1, wherein the designated distance is equal to or less than 10% of the webbing width.

11. A woven tiedown or sling comprising:

a woven webbing, the woven webbing having a top surface and an oppositely facing bottom surface, edge surfaces extend between the top surface and the bottom surface; the woven webbing having a webbing width which extends from a first edge surface of the edge surfaces to a second edge surface of the edge surfaces;

visible out of service markers provided in the woven webbing at designated distances from the edge surfaces; the out of service markers are visible on the top surface or are visible on the bottom surface, or both;

the out of service markers are visually distinct from woven webbing material of the woven webbing and extend the entire length of the woven webbing;

a first out of service marker of the out of service markers extends in a direction which is parallel to the first edge surface and a second out of service marker of the out of service markers extends in a direction which is parallel to the second edge surface;

wherein the visible out of service markers serve as a tool for indicating when the amount of damage concentrated along the edge of the webbing has penetrated to a level such that the woven webbing needs to be taken out of service.

12. The woven tiedown or sling as recited in claim 11, wherein the designated distance of a first out of service marker of the out of service markers from the first edge surface is greater than 5% and less than 20% of the webbing width and the designated distance of a second out of service marker of the out of service markers from the second edge surface is greater than 5% and less than 20% of the webbing width.

13. The woven tiedown or sling as recited in claim 11, wherein the designated distance of a first out of service marker of the out of service markers from the first edge surface is greater than 5% and less than 15% of the webbing width and the designated distance of a second out of service marker of the out of service markers from the second edge surface is greater than 5% and less than 15% of the webbing width.

14. The woven tiedown or sling as recited in claim 11, wherein the out of service markers are yarn which are woven into the woven webbing.

15. The woven tiedown or sling as recited in claim 14, wherein the out of service markers are a different color yarn than the color of the woven webbing material.

16. The woven tiedown or sling as recited in claim 15, wherein the out of service markers are a coated yarn to increase the stiffness of the out of service markers.

17. The woven tiedown or sling as recited in claim 11, wherein damage indicators are provided in the woven webbing and are positioned between the out of service markers and the edge surfaces, the damage indicators extend from the top surface to the bottom surface, wherein the damage indicators are visible on the top surface and are visible on the bottom surface, the damage indicators are visually distinct from the out of service markers and the woven webbing material of the woven webbing.

18. The woven tiedown or sling as recited in claim 17, wherein a distance of a first damage indicator of the damage indicators from the first edge surface is equal to or less than 90% of designated distance of the first out of service marker from the first edge surface and a distance of a second damage indicator of the damage indicators from the second edge surface is equal to or less than 90% of designated distance of the second out of service marker from the second edge surface, wherein the damage indicators indicate when the woven webbing is nearing a time to be taken out of service.

19. A woven tiedown or sling comprising:

a woven webbing, the woven webbing having a top surface and an oppositely facing bottom surface, edge surfaces extend between the top surface and the bottom surface, the woven webbing having a webbing width which extends from a first edge surface of the edge surfaces to a second edge surface of the edge surfaces;

visible out of service markers provided in the woven webbing and are spaced from the edge surfaces, the out of service markers are visible on the top surface and are visible on the bottom surface;

damage indicators are provided in the woven webbing and are positioned between the out of service markers and the edge surfaces, the damage indicators are visible on the top surface or are visible on the bottom surface, or both;

wherein the damage indicators indicates when the woven webbing is nearing a time to be taken out of service and the out of service markers serve as a tool for indicating when the amount of damage concentrated along the edge of the webbing has penetrated to a level such that the woven webbing needs to be taken out of service.

20. The woven tiedown or sling as recited in claim 19, wherein out of service markers are positioned at designated distances from the edge surfaces, the designated distance of a first out of service marker of the out of service markers from the first edge surface is not greater than 20% of the webbing width and the designated distance of a second out of service marker of the out of service markers from the second edge surface is not greater than 20% of the webbing width.

* * * * *